US005094735A

United States Patent [19]

Lang, Jr.

[11] Patent Number: 5,094,735

[45] Date of Patent: Mar. 10, 1992

[54] PLATING WORKSTATION SUPPORT

[75] Inventor: Donald C. Lang, Jr., Waterbury, Conn.

[73] Assignee: The Mitchell-Bate Company, Waterbury, Conn.

[21] Appl. No.: 537,605

[22] Filed: Jun. 14, 1990

[51] Int. Cl.[5] ..... C25D 17/08

[52] U.S. Cl. ..... 204/288; 204/286; 204/297 W; 204/298 R; 118/500

[58] Field of Search ..... 204/198, 279, 286, 288, 204/297 R, 297 W; 118/500, 503

[56] References Cited

U.S. PATENT DOCUMENTS

| | | | |
|---|---|---|---|
| 3,556,977 | 1/1971 | Elbaum | 204/297 W |
| 4,540,478 | 9/1985 | Mallok et al. | 204/297 W |
| 4,871,436 | 10/1989 | den Hartog | 284/256 |

*Primary Examiner*—John Niebling
*Assistant Examiner*—Kathryn Gorgos
*Attorney, Agent, or Firm*—John H. Crozier

[57] ABSTRACT

In a preferred embodiment, a plating workstation support having a central conductive copper core which is covered with a protective layer of 316 stainless steel or titanium for corrosion resistance. Conventional plastic coated workstations are removably attached to stainless steel or titanium bars welded to the protective layer. The protective layer and the bars are protected against plating thereof by a PVC tube fitted therearound.

6 Claims, 1 Drawing Sheet

PLATING WORKSTATION SUPPORT

BACKGROUND OF THE INVENTION

1. Field of the Invention

The present invention relates generally to means for supporting parts in plating and etching solutions and, more particularly, to a novel workstation support for electroplating and etching processes, in which support the conductive core thereof is protected against corrosion. The support is readily reparable.

2. Background Art

Electroplated coatings are well known and commonly have the purpose of improving appearance, corrosion resistance, hardness, bearing qualities, or other properties of the base metal or other material on which the coating is produced. Typical examples are: plating of steel with copper, nickel, and chromium in the automotive field; the manufacture of silver-plated tableware; and the manufacture of printed circuit boards.

In the the various manufacturing processes, a part to be plated may be suspended in etching and plating baths in which materials are removed from or plated onto a surface of the part. It is, therefore, necessary to provide some means for holding the part suspended in the baths. Heretofore, the means by which this was accomplished was a workstation of some configuration having means to releasably secure the part in the workstation. The workstation was permanently attached to a conductive copper support which was adapted to be hung from, and in electrical contact with, a main conductive bar. To protect the workstation and the conductive support from corrosion and from being etched and/or plated, the support and the one or more workstations attached thereto were coated with a protective plastic material.

While the conventional plating workstation support has been somewhat satisfactory, it has several substantial disadvantages. A major disadvantage is that conventional work station supports have limited lives, since once the protective plastic coating becomes dry and brittle, cracks form therein through which the plating and/or etching solutions can migrate, and, therefore, the copper conductive support and the workstations are rapidly corroded. Also, such cracks tend to trap solutions and drag incompatible solutions from one plating tank to another. This may decrease the effectiveness of the solutions in subsequent tanks and may increase the cost of waste treatment operations, since treating mixed waste streams is usually more expensive than treating waste streams containing only one impurity or one class of impurities.

A further, and related, disadvantage is that with many workstations on one plating line, the operator thereof is hesitant to promptly replace or repair the entire equipment and, therefore, the problem becomes aggravated.

Additionally, the conventional methods of "repair" of such a support and the workstations have been to either burn the plastic coating from the metallic materials or to strip the plastic by dissolving it in methylene chloride. Neither of these methods will continue to be viable, since each results in environmental problems: the first due to airborne smoke and combustion products, the second due to a health hazard presented by the solvent.

Accordingly, it is a principal object of the present invention to provide a work station support that has a long life.

It is an additional object of the invention to provide such a workstation support to which workstations may be removably attached for convenient replacement thereof.

it is a further object of the invention to produce such a workstation support that is easily and economically constructed.

Other objects of the present invention, as well as particular features and advantages thereof, will be elucidated in, or be apparent from, the following description and the accompanying drawing figures.

SUMMARY OF THE INVENTION

The present invention achieves the above objects, among others, by Providing, in a preferred embodiment, a plating workstation support having a central conductive copper core which is covered with a protective layer of 316 stainless steel or titanium for corrosion resistance. Conventional plastic coated workstations are removably attached to stainless steel or titanium bars welded to the protective layer. The protective layer and the bars are protected against plating thereof by a polyvinyl chloride tube fitted therearound.

BRIEF DESCRIPTION OF THE DRAWING

Understanding of the present invention and the various aspects thereof will be facilitated by reference to the accompanying drawing figures, in which.

DETAILED DESCRIPTION OF THE PREFERRED EMBODIMENTS

Figure 2:
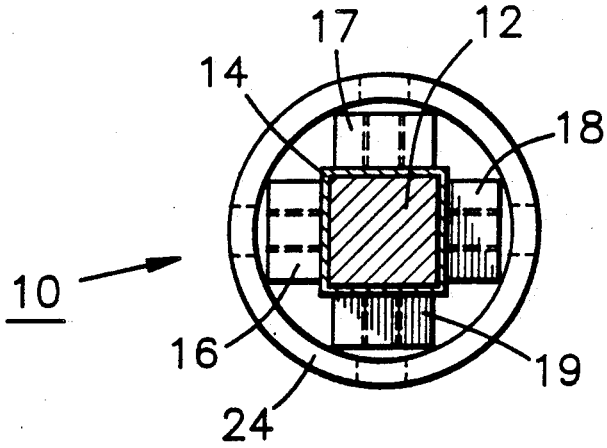
FIG. 2 is a top plan view of the workstation support of FIG. 1.
Figure 1:
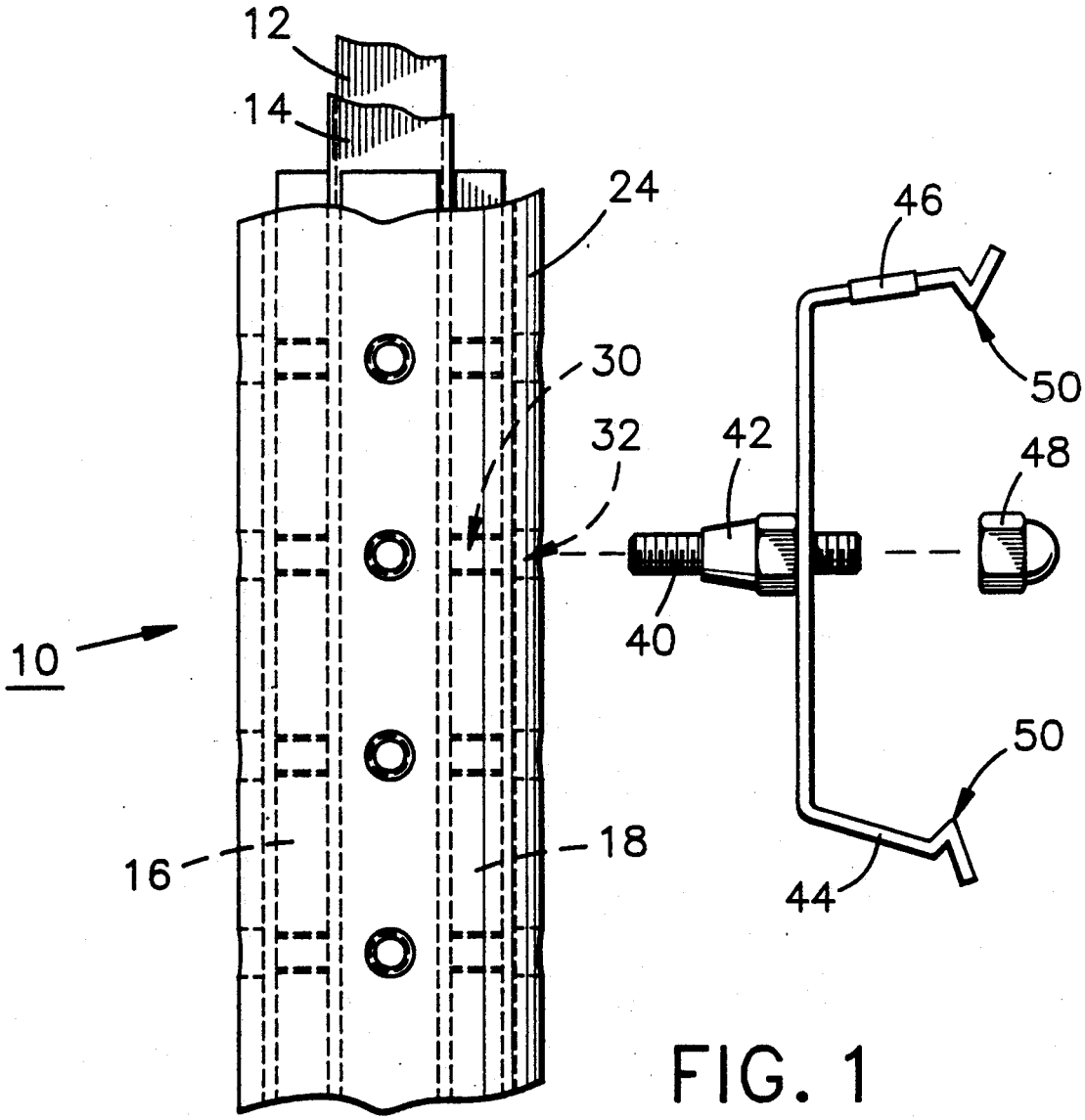
FIG. 1 is a side elevation view of a workstation support according to the present invention illustrating the means by which a workstation may be removably attached thereto.

Referring now to the Drawing, in which similar elements thereof are given consistent identifying numerals throughout the various views thereof, there is shown a workstation support generally indicated by the reference numeral 10.

Workstation support 10 includes a square, central, copper conductive core 12 having on the surface thereof a corrosion resistant protective layer 14 of type 316 stainless steel or titanium welded to the core. Longitudinally disposed on the sides of conductor 12 and attached by means of stitch welding to protective layer 14 are four mounting bars 16–19 of type 316 stainless steel or titanium. A protective cylindrical, polyvinyl chloride barrier tube 24 is disposed around the periphery of mounting bars 16–19. A plurality of threaded holes, as at 30, are formed in mounting bars 16–19, each having a concentric clearance hole, as at 32, formed in barrier tube 24, the clearance holes having a diameter slightly larger than that of the threaded holes.

Each of threaded holes 30 is adapted to threadingly accept the proximal end of a threaded type 316 stainless steel rod 40 having thereon a knurled finger nut 42 to facilitate threading of the proximal end of the threaded rod into the threaded hole. Adapted to be attached to the distal end of threaded rod 40 is a metallic workstation 44 which may take any number of forms for the temporary attachment thereto of a part or parts (not shown) to be plated and which workstation, as well as finger nut 42, is coated with a conventional protective plastic material 46. Workstation 44 is held on the distal end of threaded rod 40 by means of a plastic cap nut 48.

In use, a number of workstations 44 may be attached to support 10 and, typically, at any horizontal plane through threaded holes 30, there may be an opposed pair of workstations or there may be two pairs of opposed workstations. A part (not shown) to be plated is attached to workstation 44 and then support 10 is hung from a main conductive bar (not shown). Support 10 is then lowered into a plating solution so that the part is covered and an electrical potential is imposed between the main conductive bar and the plating solution. The conductive path therebetween is from the main conductive bar, along conductive core 12, through protective layer 14 to mounting bars 16–19, along threaded rod 40, through workstation 44 to bare contact points 50 on the workstation, which contact points are in electrical contact with the part to be plated, and to the solution through the part.

Plastic coating 46 prevents workstation 44 from being plated, while barrier tube 24 shields the metallic parts of support 10 from being plated. In order to prevent unused threaded holes 30 from being plated, additional threaded rods 40 with knurled finger nuts 42 thereon are provided in any such holes to which workstations are not mounted. Engagement of knurled finger nuts 42 with the peripheral edges of clearance holes 32 helps maintain the integrity of barrier tube 24 and secures the tube to mounting bars 16–19.

The ends of barrier tube 24 are preferably intentionally left open so that solution will readily drain from the tube and not be dragged to the next tank. If an attempt were made to have barrier tube 24 liquid tight, there would be the problem of dragging solution from one tank to another, with the attendant increased waste treatment costs, should the integrity of the cylinder ever be broken.

Should plastic covering 46 on workstation 44 age or otherwise be damaged or should a thorough cleaning be indicated, it is a simple matter to unscrew workstations 44 and replace them.

As noted above, protective layer 14 protects conductive core 12 from corroding, and, therefore, support 10 has extremely long life compared to conventional supports.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A support for plating workstations, comprising:

(a) an elongated central conductive core to convey an electric current;

(b) a corrosion resistant metallic layer disposed upon the surface of said core;

(c) means to mount at least one of said workstations in electrical engagement with said conductive core; and (d) a protective barrier surrounding metallic parts of said workstation support to prevent the plating thereof, said protective barrier having open ends so that plating solution can drain therefrom.

2. A plating workstation support, as defined in claim 1, wherein said means to mount comprises at least one mounting bar attached to said corrosion resistant layer, extending substantially along the length of said core, and said at least one workstation is removably attached to said at least one mounting bar.

3. A plating workstation support, as defined in claim 2, wherein said at least one mounting bar is formed of type 316 stainless steel or titanium.

4. A plating workstation support, as defined in claim 2, wherein said at least one workstation is removably attached to said at least one mounting bar by means of a threaded rod extending into said at least one mounting bar.

5. A plating workstation support, as defined in claim 1, wherein said central conductive core is formed of copper and said corrosion resistant metallic layer is formed of type 316 stainless or titanium.

6. A plating workstation support, as defined in claim 1, wherein said protective barrier is formed of a polyvinyl chloride tube.

* * * * *